US008607487B1

(12) United States Patent
Magness

(10) Patent No.: US 8,607,487 B1
(45) Date of Patent: Dec. 17, 2013

(54) LIFE SUPPORT ALGORITHM DISPLAY SYSTEM

(71) Applicant: William P. Magness, Port Richey, FL (US)

(72) Inventor: William P. Magness, Port Richey, FL (US)

( * ) Notice: Subject to any disclaimer, the term of this patent is extended or adjusted under 35 U.S.C. 154(b) by 0 days.

(21) Appl. No.: 13/783,927

(22) Filed: Mar. 4, 2013

(51) Int. Cl.
*G09F 3/00* (2006.01)

(52) U.S. Cl.
USPC ..... 40/607.12; 40/316; 40/651; 206/570

(58) Field of Classification Search
USPC ..... 40/611.13, 649, 658, 666, 734, 743, 40/752, 777; 206/570
See application file for complete search history.

(56) References Cited

U.S. PATENT DOCUMENTS

| | | | | | |
|---|---|---|---|---|---|
| 3,955,298 | A * | 5/1976 | Kapstad | 40/782 |
| 4,108,310 | A | 8/1978 | Aldridge et al. | |
| 4,292,749 | A * | 10/1981 | Thomas | 40/308 |
| 4,790,610 | A | 12/1988 | Welch et al. | |
| 5,055,099 | A | 10/1991 | Mintz | |
| 5,433,036 | A * | 7/1995 | Ganal | 40/729 |
| 5,848,700 | A | 12/1998 | Horn | |
| 5,911,525 | A * | 6/1999 | Jepsen et al. | 40/611.06 |
| 5,974,708 | A * | 11/1999 | Webb et al. | 40/316 |
| 5,992,073 | A * | 11/1999 | Wolpa | 40/651 |
| 6,112,445 | A * | 9/2000 | Feeney | 40/747 |
| 6,460,702 | B2 | 10/2002 | Hammond | |
| 6,609,026 | B2 | 8/2003 | Salvatori et al. | |
| 6,782,649 | B1 * | 8/2004 | Adler | 40/734 |
| 6,823,617 | B2 * | 11/2004 | Schweikert | 40/299.01 |
| 7,310,553 | B2 | 12/2007 | Freeman | |
| 8,286,379 | B2 * | 10/2012 | Martin | 40/645 |
| 2002/0073589 | A1 * | 6/2002 | Tate | 40/666 |
| 2004/0107610 | A1 * | 6/2004 | Gulati | 40/316 |
| 2010/0121273 | A1 | 5/2010 | Kochanek et al. | |

* cited by examiner

*Primary Examiner* — Joanne Silbermann
*Assistant Examiner* — Shin Kim

(57) ABSTRACT

A life support algorithm display system for providing convenient access to basic life support or advanced life support algorithms for a user during an emergency features an I.V. (intravenous) pole located on a base. The system features a plurality of rectangular life support algorithm cards with a tab located on a card bottom edge. A life support algorithm is printed on each card. The system features a plurality of display modules each having a side arm attached to a clip. The clip is adapted to snugly, yet pivotally clip onto the I.V. pole allowing the display module to rotate around the I.V. pole. Each life support algorithm card is located in a display module with the tab passing through a module bottom aperture. Each display module is clipped onto the I.V. pole and adapted to be rotated for viewing.

3 Claims, 6 Drawing Sheets

(UPSIDE DOWN)

LIFE SUPPORT ALGORITHM DISPLAY SYSTEM

FIELD OF THE INVENTION

The present invention relates to medical equipment, more specifically I.V. poles having mounted display systems thereon.

BACKGROUND OF THE INVENTION

Through the years, great strides have been made with regards to saving lives of individuals during a medical emergency. Basic Life Support (BLS) and Advanced Cardiovascular Life Support (ACLS) systems have been developed and taught to those in the medical community to provide immediate help in the event of a life threatening medical emergency by using a specific sequence of steps (algorithms) to aid the patient. Sometimes, although trained, medical professionals of all levels may have trouble remembering a particular algorithm or a sequence for the algorithms when the situation becomes intense. The present invention features a life support algorithm display system for providing convenient access to basic life support or advanced life support algorithms for a user during an emergency.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

A life support algorithm display system for providing convenient access to basic life support or advanced life support algorithms for a user during an emergency comprises an I.V. (intravenous) pole located on a base. In some embodiments, the system comprises a plurality of rectangular life support algorithm cards. In some embodiments, a tab is located on card bottom edge. In some embodiments, a life support algorithm is printed on the card. In some embodiments, the system comprises a plurality of display modules. In some embodiments, each display module comprises a side arm attached to a clip. In some embodiments, the clip is adapted to snugly, yet pivotally clip onto the I.V. pole allowing the display module to rotate around the I.V. pole. In some embodiments, each life support algorithm card is located in a display module with the tab passing through a module bottom aperture. In some embodiments, each display module is clipped onto the I.V. pole in a vertically offsetting location and adapted to be rotated for viewing via the tab extending through the bottom aperture.

DESCRIPTION OF PREFERRED EMBODIMENTS

Figure 1:
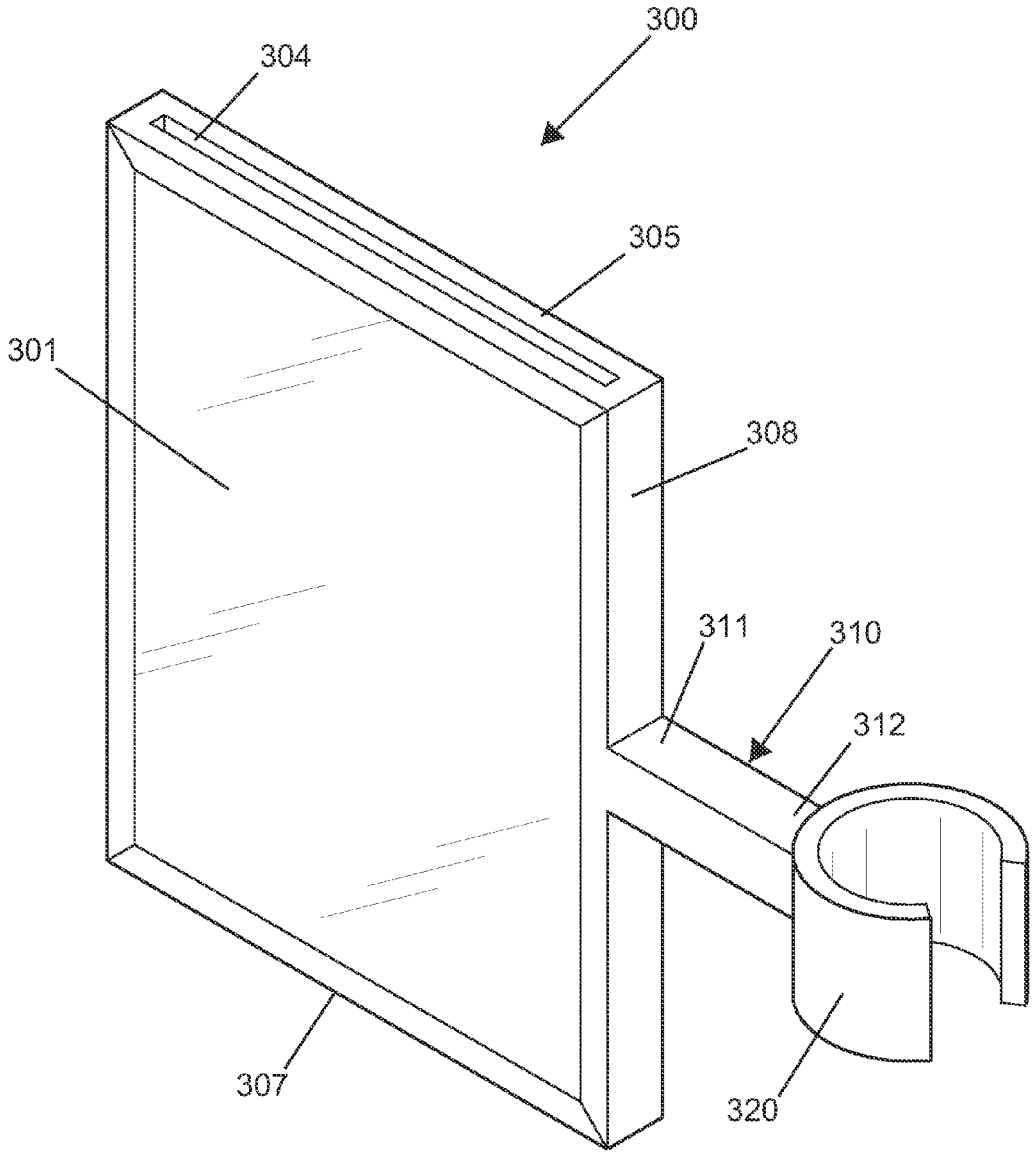
FIG. 1 shows a perspective view of the display module of the present invention.
Figure 3:
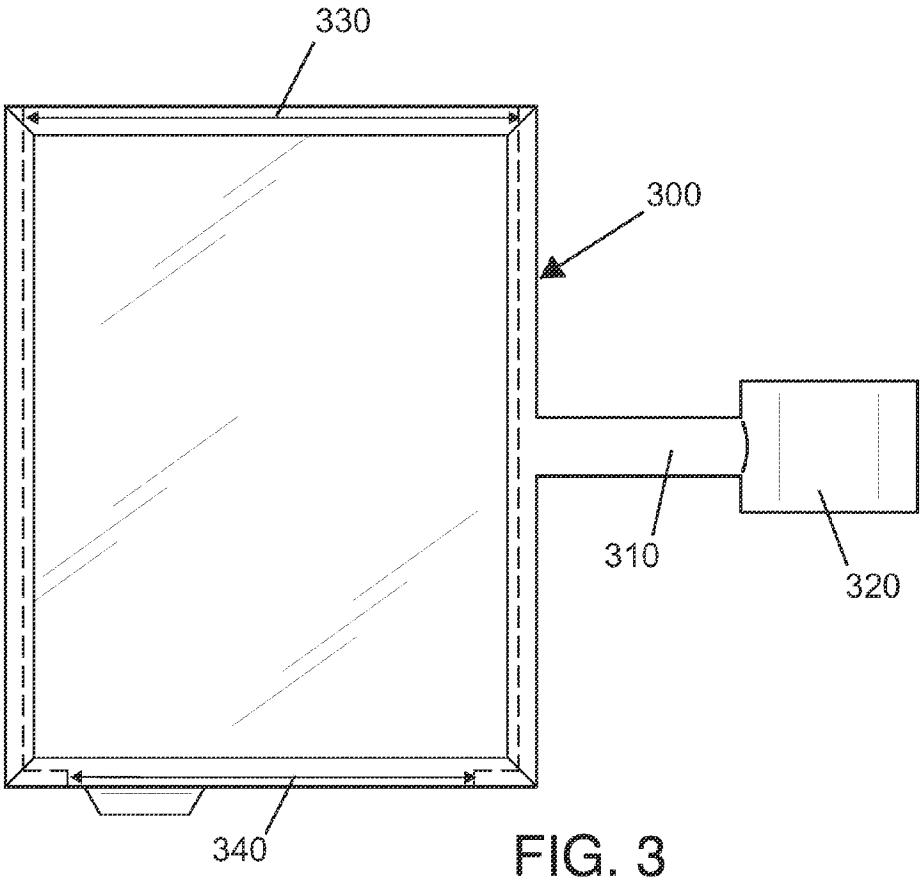
FIG. 3 shows a front view of the display module of the present invention.
Figure 2:
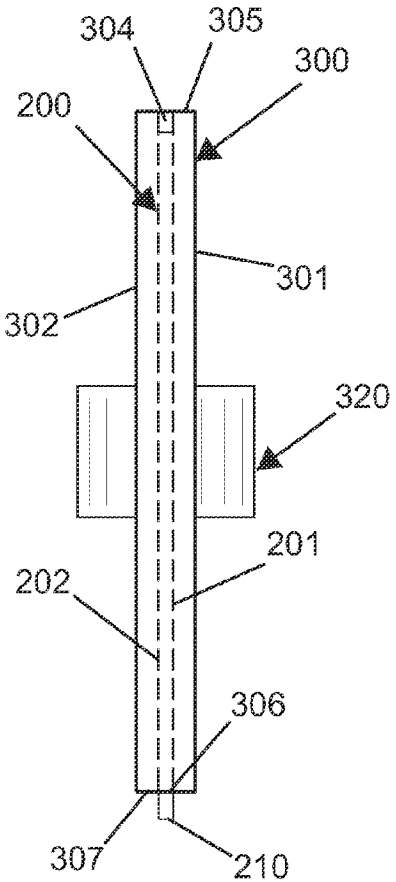
FIG. 2 shows a side view of the display module of the present invention.
Figure 4:
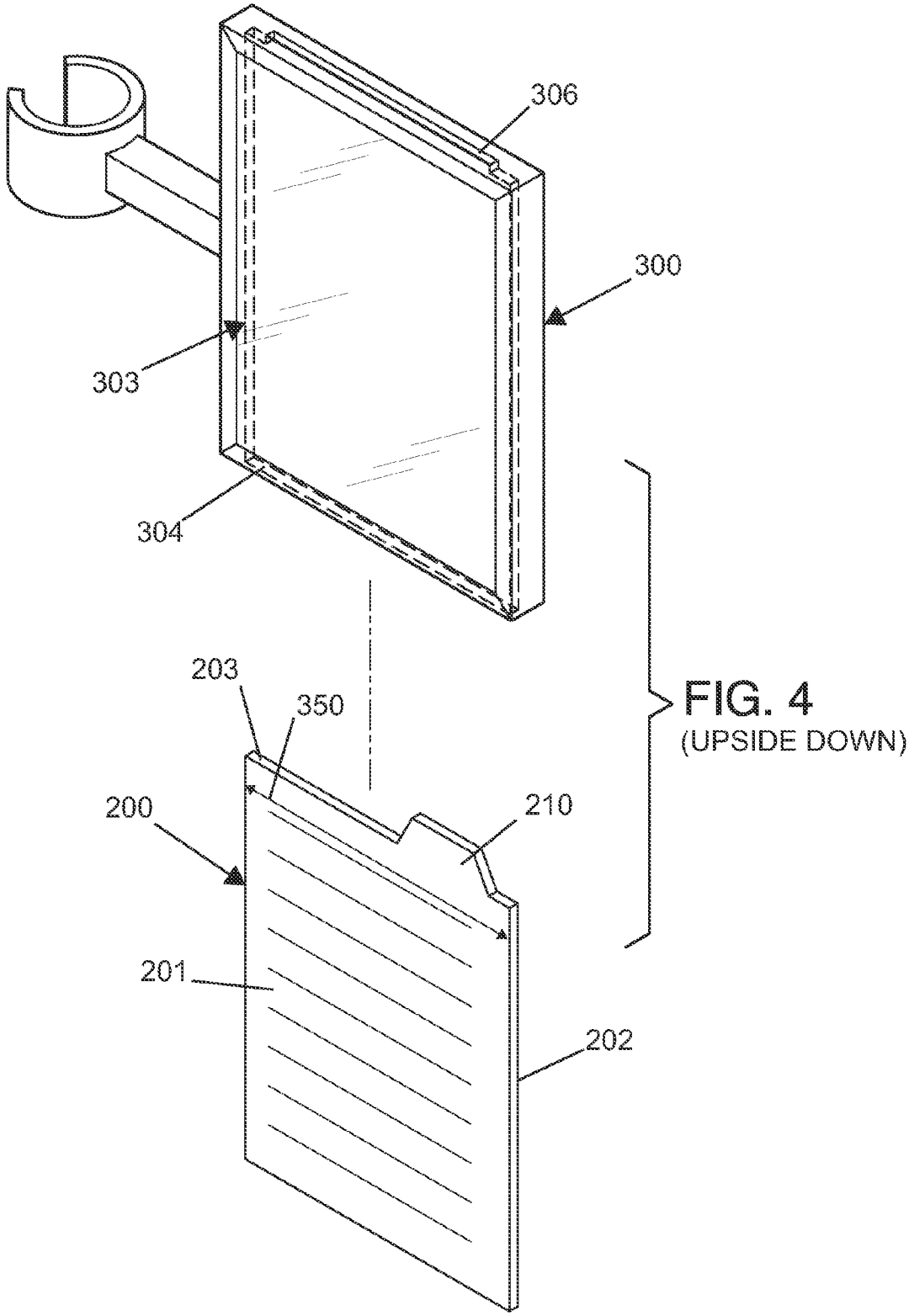
FIG. 4 shows an upside down view of the display module and the life support algorithm card of the present invention.
Figure 5:
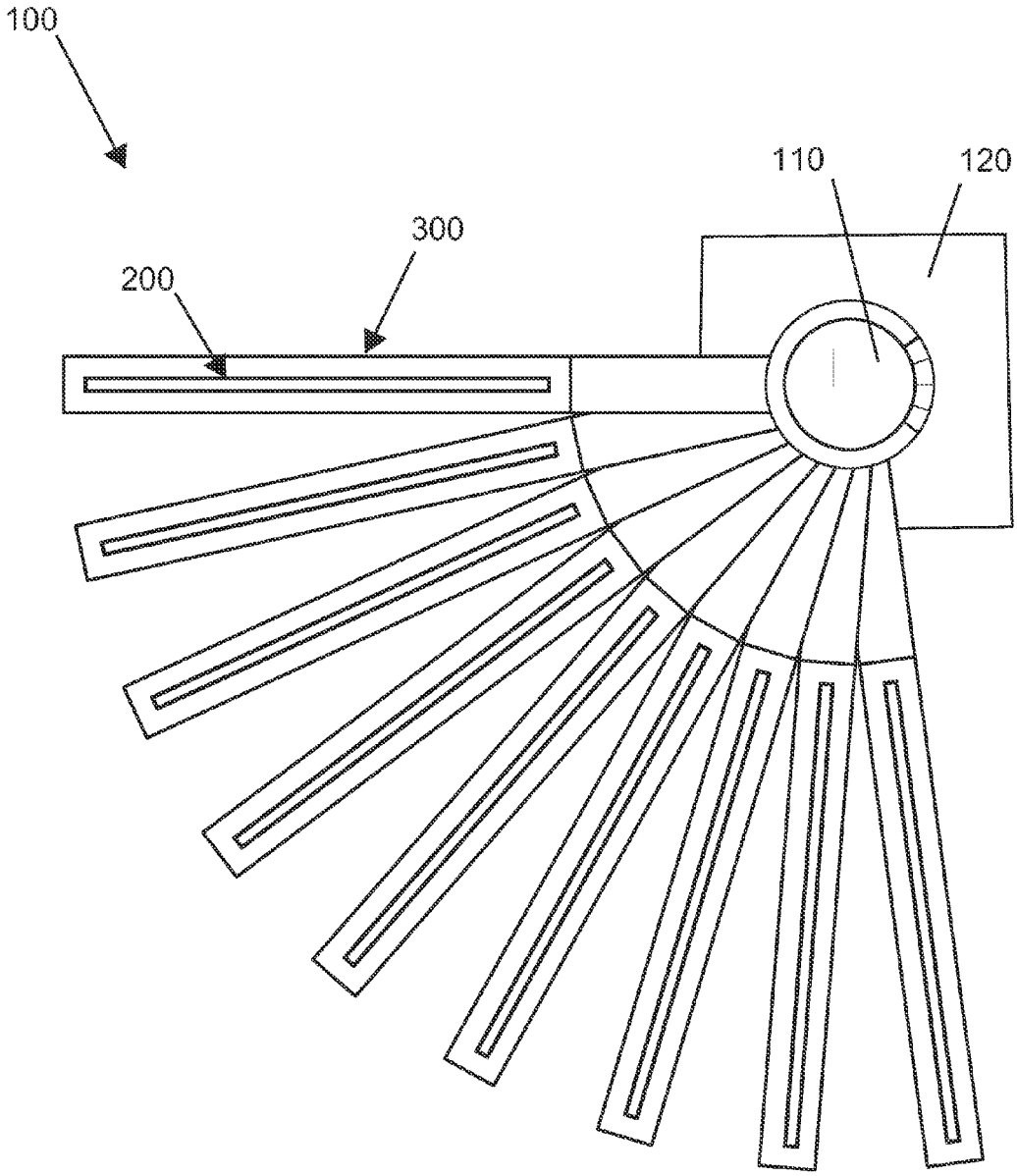
FIG. 5 shows a top view of the present invention.
Figure 6:
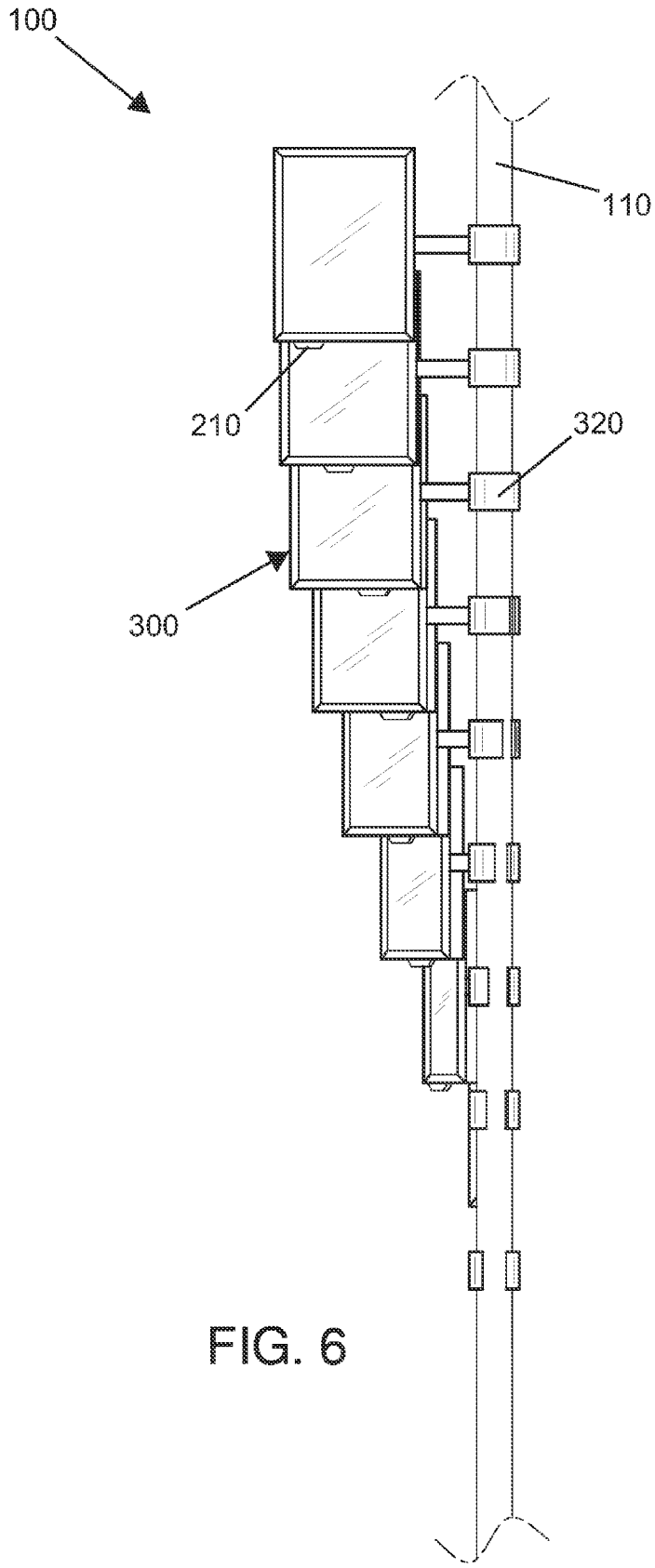
FIG. 6 shows a front view of the present invention.
Figure 7:
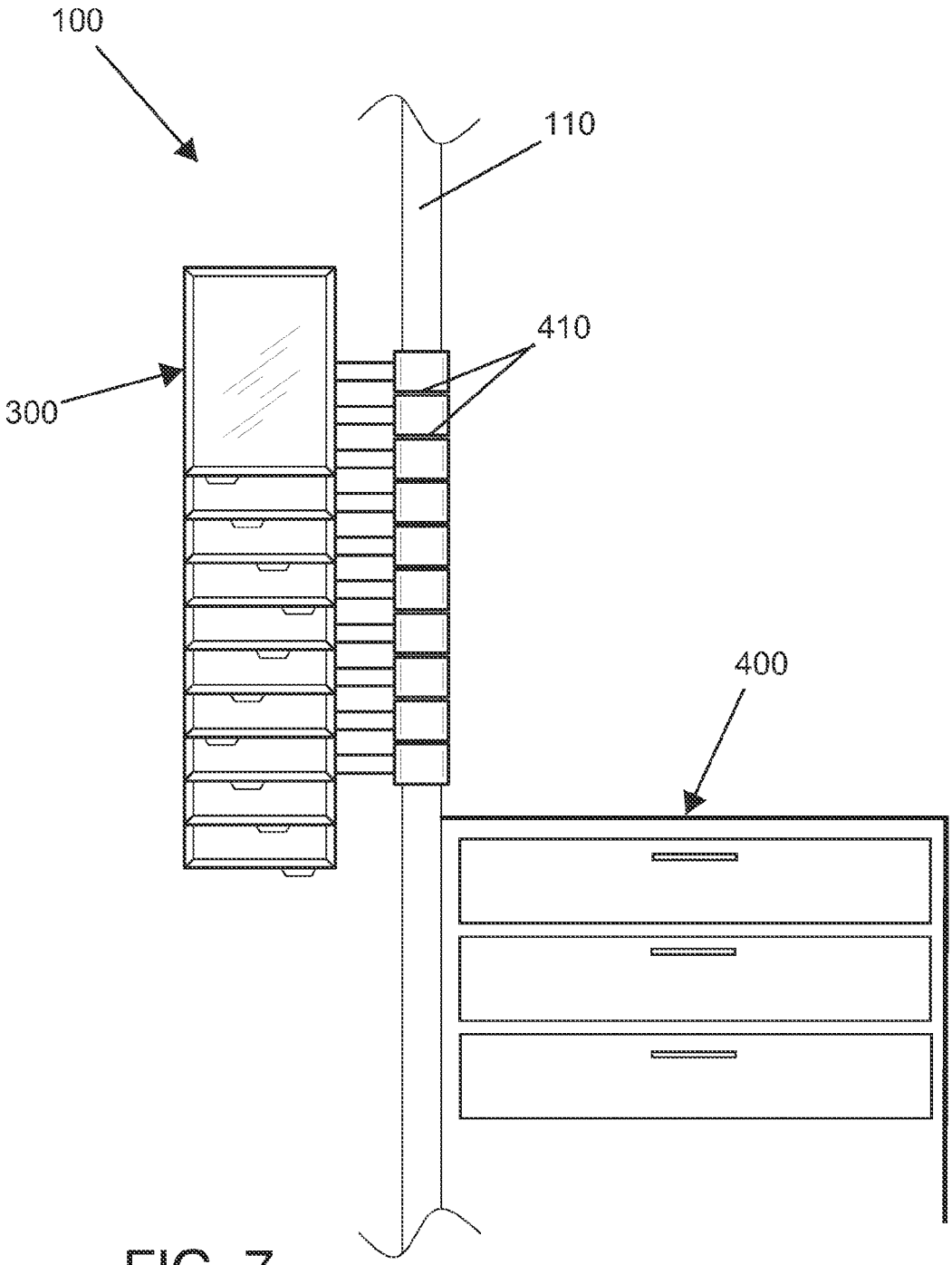
FIG. 7 shows a front view of an alternate embodiment of the present invention.

Following is a list of elements corresponding to a particular element referred to herein:

100 Life support algorithm system
110 I.V. pole
120 Base
200 Life support algorithm card
201 Card front surface
202 Card back surface
203 Card bottom surface
210 Tab
300 Display module
301 Module first face
302 Module second face
303 Cavity
304 Module top aperture
305 Module top edge
306 Module bottom aperture
307 Module bottom edge
308 Module first side
310 Side arm
311 Arm first end
312 Arm second end
320 Clip
330 Module top aperture width
340 Module bottom aperture width
350 Life support algorithm card width
400 Crash cart
410 Ring spacer Referring now to FIG. 1-7, the present invention features a life support algorithm display system (100) for providing convenient access to basic life support or advanced life support algorithms for a user during an emergency. In some embodiments, the system (100) comprises a rigid, linear, I.V. (intravenous) pole (110) located on a base (120). In some embodiments, the base (120) comprises wheels. In some embodiments, the base is attached to a crash cart (400), a gurney, a wheelchair, or a bed.

In some embodiments, the system (100) comprises a plurality of rectangular life support algorithm cards (200). In some embodiments, the system (100) comprises a plurality of polygonal life support algorithm cards (200). In some embodiments, the system (100) comprises a plurality of life support algorithm cards (200) having rounded edges. In some embodiments, the plurality comprises between 6 and 12 life support algorithm cards (200). In some embodiments, the plurality comprises 6 life support algorithm cards (200). In some embodiments, the plurality comprises 7 life support algorithm cards (200). In some embodiments, the plurality comprises 8 life support algorithm cards (200). In some embodiments, the plurality comprises 9 life support algorithm cards (200). In some embodiments, the plurality comprises 10 life support algorithm cards (200). In some embodiments, the plurality comprises 11 life support algorithm cards (200). In some embodiments, the plurality comprises 12 or more life support algorithm cards (200).

In some embodiments, the life support algorithm card (200) comprises a card front surface (201), a card back surface (202), and a card bottom edge (203) having a tab (210) located thereon. In some embodiments, the bottom edge (203) is the tab (210).

In some embodiments, the tab (210) is located on one of at least two offsetting locations on the card bottom edge (203) for each of the plurality of life support algorithm cards (200). In some embodiments, the tab (210) is located on one of at least three offsetting locations on the card bottom edge (203) for each of the plurality of life support algorithm cards (200). In some embodiments, the tab (210) is located on one of four or more offsetting locations on the card bottom edge (203) for each of the plurality of life support algorithm cards (200). In some embodiments, a life support algorithm is printed on the card front surface (201) or the card back surface (202) of each life support algorithm card (200). In some embodiments, a life support algorithm is printed on the card front surface (201) and the card back surface (202) of each life support algorithm card (200).

In some embodiments, the system (100) comprises a plurality of rigid display modules (300). In some embodiments, the plurality comprises between 6 and 12 display modules (300). In some embodiments, the plurality comprises 6 display modules (300). In some embodiments, the plurality comprises 7 display modules (300). In some embodiments, the plurality comprises 8 display modules (300). In some embodiments, the plurality comprises 9 display modules (300). In some embodiments, the plurality comprises 10 display modules (300). In some embodiments, the plurality comprises 11 display modules (300). In some embodiments, the plurality comprises 12 or more display modules (300).

In some embodiments, the display module (300) comprises a transparent module first face (301), a transparent module second face (302), a cavity (303) located between the module first face (301) and the module second face (302), a module top aperture (304) located on a module top edge (305) fluidly connected to the cavity (303), a module bottom aperture (306) located on a module bottom edge (307) fluidly connected to the cavity (303), a side arm (310) having an arm first end (311) centrally located on a module first side (308), and an arm second end (312) located on a clip (320). In some embodiments, the clip (320) is adapted to snugly, yet pivotally clip onto the I.V. pole (110) allowing the display module (300) to rotate around the I.V. pole (110). In some embodiments, the clip (320) will not slide down the I.V. pole (110).

In some embodiments, each life support algorithm card (200) is located in a respective display module (300). In some embodiments, the module top aperture (304) comprises a module top aperture width (330) larger than a life support algorithm card width (350) for allowing the life support algorithm card (200) to pass through. In some embodiments, the module bottom aperture (306) comprises a module bottom aperture width (340) smaller than the life support algorithm card width (350) for preventing the life support algorithm card (200) from passing through, thus holding the life support algorithm card (200) in the cavity (303). In some embodiments, the tab (210) passes through the module bottom aperture (306). In some embodiments, only the tab (210) passes through the module bottom aperture (306).

In some embodiments, each display module (300) is clipped onto the I.V. pole (110) in a vertically sequentially offsetting location. In some embodiments, each display module (300) is adapted to be rotated for viewing via the tab (210) extending through the module bottom aperture (306).

In some embodiments, the I.V. pole (110) is located on a crash cart (400), a gurney, a wheelchair, or a bed.

In some embodiments, a ring spacer (410) is located on the I.V. pole (110) between each clip (320).

As used herein, the term "about" refers to plus or minus 10% of the referenced number.

The disclosures of the following U.S. Patents are incorporated in their entirety by reference herein: U.S. Pat. No. 4,108,310; U.S. Pat. No. 4,790,610; U.S. Pat. No. 5,055,099; U.S. Pat. No. 5,848,700; U.S. Pat. No. 6,460,702; U.S. Pat. No. 6,609,026; and U.S. Patent Pub. No. 2010/0121273.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. A life support algorithm display system (100) for providing convenient access to basic life support or advanced life support algorithms for a user during an emergency, the system (100) comprises:

(a) a rigid, linear, I.V. (intravenous) pole (110) disposed on a base (120);

(b) a plurality of rectangular life support algorithm cards (200), wherein the plurality comprises between 6 and 12 life support algorithm cards (200), wherein the life support algorithm card (200) comprises a card front surface (201), a card back surface (202), and a card bottom edge (203) having a tab (210) disposed thereon, wherein the tab (210) is disposed on one of at least two offsetting locations on the card bottom edge (203) for each of the plurality of life support algorithm cards (200), wherein a life support algorithm is printed on the card front surface (201) or the card back surface (202) of each life support algorithm card (200); and (c) a plurality of rigid display modules (300), wherein the plurality comprises between 6 and 12 display modules (300), wherein the display module (300) comprises a transparent module first face (301), a transparent module second face (302), a cavity (303) disposed between the module first face (301) and the module second face (302), a module top aperture (304) disposed on a module top edge (305) fluidly connected to the cavity (303), a module bottom aperture (306) disposed on a module bottom edge (307) fluidly connected to the cavity (303), a side arm (310) having an arm first end (311) centrally disposed on a module first side (308), and an arm second end (312) disposed on a clip (320), wherein the clip (320) is adapted to snugly, yet pivotally clip onto the I.V. pole (110) allowing the display module (300) to rotate around the I.V. pole (110);

wherein each life support algorithm card (200) is disposed in the respective display module (300), wherein the module top aperture (304) comprises a module top aperture width (330) larger than a life support algorithm card width (350) for allowing the life support algorithm card (200) to pass through, wherein the module bottom aperture (306) comprises a module bottom aperture with (340) smaller than the life support algorithm card width (350) for preventing the life support algorithm card (200) from passing through, wherein the tab (210) passes through the module bottom aperture (306);

wherein each display module (300) is clipped onto the I.V. pole (110) in a vertically sequentially offsetting location, wherein each display module (300) is adapted to be rotated for viewing via the tab (210) extending through the module bottom aperture (306).

2. The system (100) of clan 1, wherein the I.V. pole (110) is disposed on a crash cart (400).

3. The system (100) of claim 1, wherein a ring spacer (410) is disposed on the I.V. pole (110) between each clip (320).

* * * * *